United States Patent [19]

Maric

[11] 4,275,635

[45] Jun. 30, 1981

[54] ACCORDION WITH A NEW ORDER OF SOUNDS AND MECHANICAL REED OPENING SYSTEM

[76] Inventor: Petar Marić, 3, Djure Jaksica, Pancevo, Yugoslavia, 26000

[21] Appl. No.: 67,619

[22] Filed: Aug. 14, 1979

[51] Int. Cl.[3] ..... G10D 11/02

[52] U.S. Cl. ..... 84/376 R

[58] Field of Search ..... 84/376

[56] References Cited

U.S. PATENT DOCUMENTS

| | | | |
|---|---|---|---|
| 1,051,398 | 1/1913 | Galleazzi | 84/376 |
| 2,069,447 | 2/1937 | Iorio | 84/376 |

*Primary Examiner*—Lawrence R. Franklin

*Attorney, Agent, or Firm*—Finnegan, Henderson, Farabow, Garrett & Dunner

[57] ABSTRACT

A reed accordion having six sounds for each register and a mechanical linkage system which permits the two additional sounds to be selectively used or not in combination with the classical four sounds for each register.

3 Claims, 3 Drawing Figures

ACCORDION WITH A NEW ORDER OF SOUNDS AND MECHANICAL REED OPENING SYSTEM

BACKGROUND OF THE INVENTION

1. Field of the Invention

The present invention relates generally to reed accordions and more specifically to a reed accordion having a new order of sounds and a mechanical system for selectively playing the new sounds.

2. Description of the Prior Art

Conventional reed accordions utilize only four orders of sounds for each register, and the pre-tuned reeds that produce the sounds are located at the rear and top surface of the accordion's sounding chamber. In a conventional system, the reeds are opened and closed by a classical key lever which is well-known in the art.

While conventional accordions provide an adequate sound system, the inventor has found that the use of six pre-tuned reeds which produce six sounds for each register provides a more melodious sound similar to that of an organ. The inventor has also designed a mechanical linkage system which is compatible with a classical key lever and which permits the two additional sound to be selectively used or not used in combination with the classical four sounds.

SUMMARY OF THE INVENTION

The object of the present invention is to provide an accordion which has six sounds for each register. It is a further object to provide a mechanical system compatible with the classical key system to selectively open and close the two additional sounds.

Additional objects and advantages of the invention will be set forth in part in the description which follows, and in part will be obvious from the description, or may be learned by practice of the invention. The objects and advantages of the invention will be realized and attained by means of the instrumentalities and combinations, particularly pointed out in the appended claims.

To achieve the objects, and in accordance with the purpose of the invention, as embodied and broadly described herein, the invention comprises a sound chamber frame, a plurality of classical reeds attached to said frame, a plurality of classical pallets positioned over said plurality of classical reeds to selectively open and close said plurality of classical reeds, said plurality of classical pallets being biased to a closed position, at least one new sound order reed attached to said frame, a new sound order pallet, positioned over said new sound order reed to selectively open and close said new sound order reed, said new sound order pallet being biased to a closed position, a classical key lever connected to said plurality of classical pallets to selectively move said pallets to an open position when said classical key lever is placed in the play position, means connected to said new sound order pallet and selectively engageable with said classical key lever for moving said new sound order pallet to an open position when said means is engageable with said classical key lever and when said classical key lever is placed in the play position.

The reed accordion of the present invention provides an accordion with a new order of sound and a corresponding new mechanical linkage system. The pre-tuned reeds for producing the six orders of sound are placed in the same sounding chamber where the four pre-tuned reeds in a classical prima accordion are located. The addition of these two additional sounds produces a more melodious accordion than found in the prior art.

The invention also provides a new mechanical linkage system. That system is compatible with the classical lever system and enables the accordion player to selectively play or not play the new sounds in combination with the classical sounds.

The new sound system and linkage system thereby offers a larger range of tones than the classical combination. In the classical mechanical system on the prima accordion, sounds emit from only two directions. The accordion of the present invention, however, permits the emission of sounds from three directions. As a result of the larger range of tones and multidirectional sound emission, the accordion offers a full range of melodical sound similar to that of an organ.

The mechanical system of the present invention is lightweight and economical. If the conventional classical mechanical system of a prima accordion was adapted to the inventor's six sound system, it would be much heavier than an accordion utilizing the inventor's new mechanical system.

It is understood that both the foregoing general description and the following detailed description are exemplary and explantory only and are not restrictive of the invention, as claimed.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference will now be made in detail to the present preferred embodiment of the invention, an example of which is illustrated in the accompanying drawings wherein like numbers refer to like parts.

Figure 1:
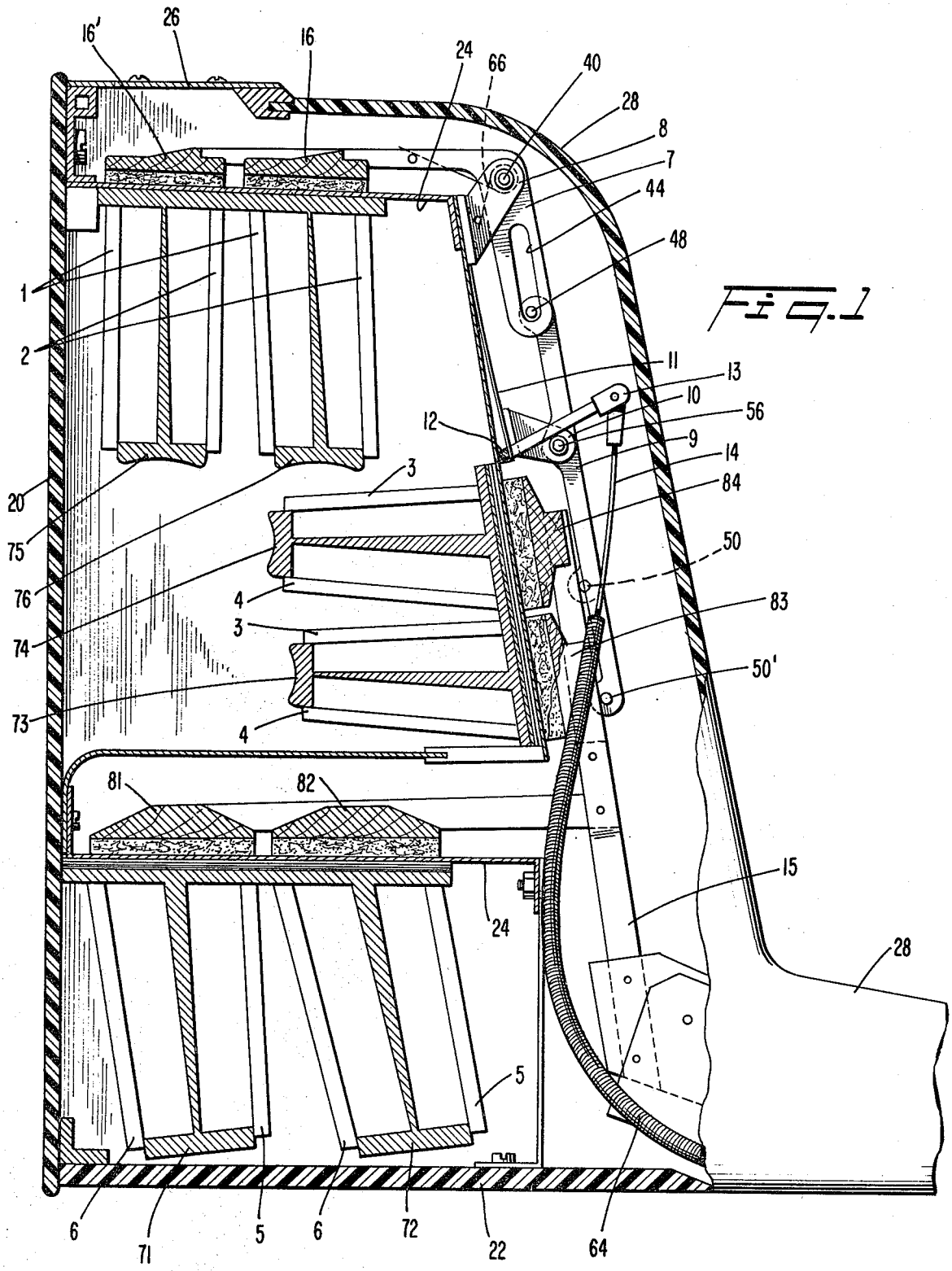
FIG. 1 is a cross sectional view of the side of the accordion according to the invention.
Figure 2:
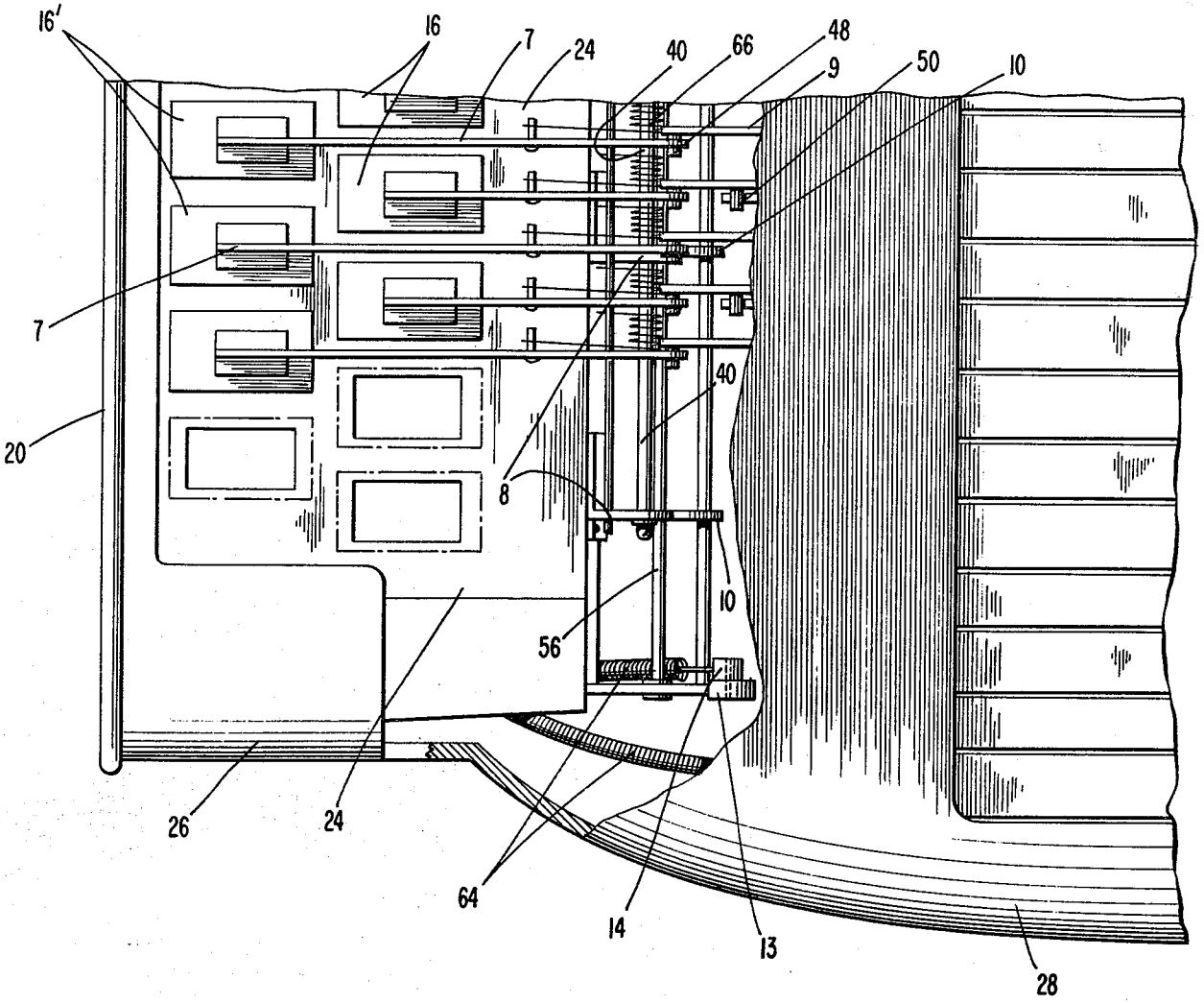
FIG. 2 is a partial front view of the accordion of the invention taken from the left of FIG. 1 with the outer cover removed.
Figure 3:
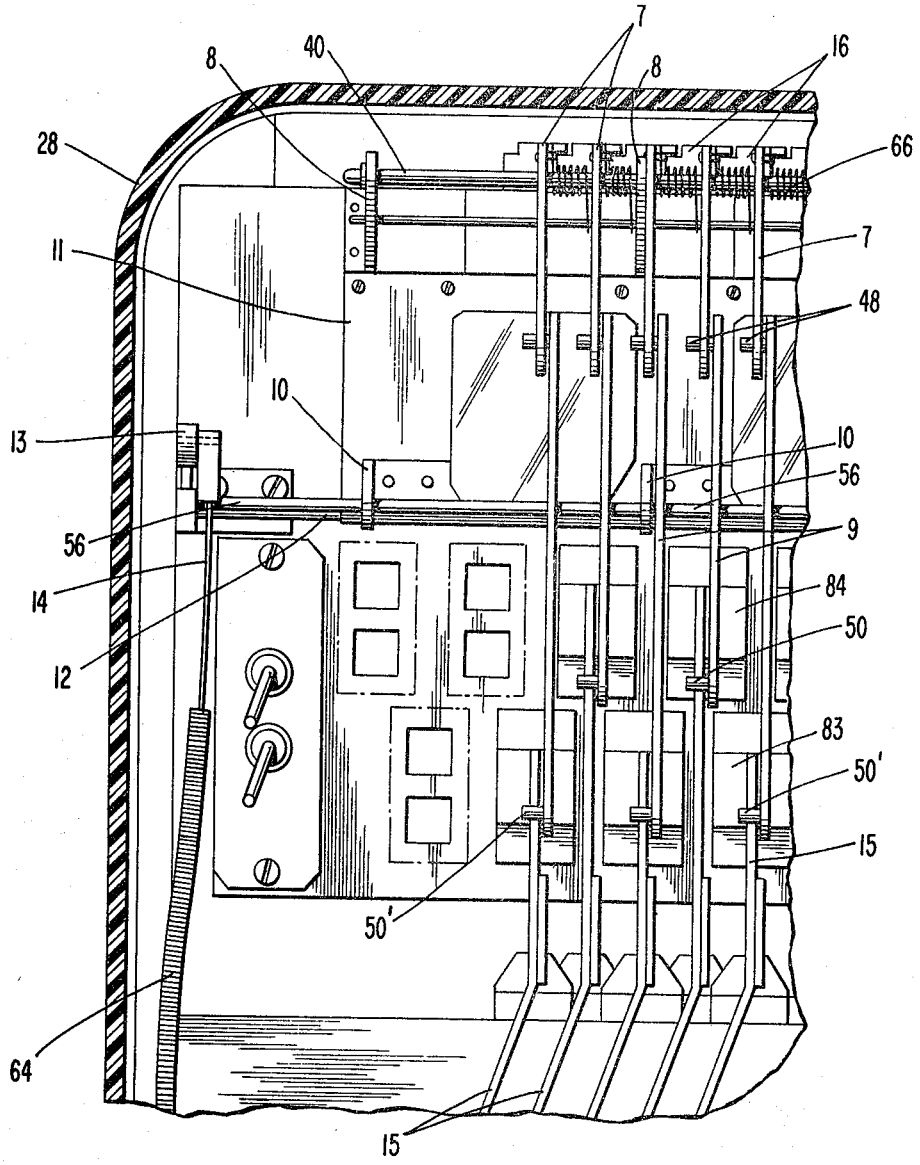
FIG. 3 is a partial top plan view of the face of the accordion taken from the top of FIG. 1 with the outer cover removed.

FIGS. 1 through 3 show the sounding chamber of a reed accordion utilizing applicant's new sound order and mechanical linkage system. The bellows and keyboard are not shown but are of the conventional type well-known in the art.

As shown in FIG. 1, the sounding chamber of the present invention includes several common elements found in a classical prima accordion. The conventional portions include a frame comprised of the bottom face 20, back face 22 and frame members 24 for supporting pre-tuned reeds 71, 72, 73, 74, 75 and 76. The accordion also includes a lower face bracket 26 and a cover 28 which is shown partially in FIG. 1. The cover 22 is not shown in either FIG. 2 or FIG. 3.

As shown in FIG. 1, the order of sounds of any register on the prima accordion according to the present invention includes the elementary sounds 1 and 2, the quintal 3, the trailer 4, the basic elementary octave 5 and the low octave 6 which is an octave lower than the basic elementary octave. The sounds 3, 4, 5 and 6 comprise the classical order of sounds produced by the conventional pre-tuned reeds 71, 72, 73 and 74. These conventional reeds are located at the classical positions found in conventional prima accordions. The elementary sounds 1 and 2 represent the two additional orders of sound added to the prima accordion by the present invention and are produced by the pre-tuned reeds 75 and 76 positioned at the face of the sound chamber.

A classical key bar 15 operates to selectively move the pallets or covers 81, 82, 83 and 84 and thereby open and close these air flow openings to pre-tuned reeds 71, 72, 73 and 74, respectively. The operation of the classical key bar is conventional and well-known.

To permit the additional pre-tuned reeds 75 and 76 and new order of sounds 1 and 2 to be compatible with the classical key lever system found on conventional prima accordions, a new mechanical linkage system is provided. The linkage permits the accordion operator to selectively play or not play the reeds 75 and 76. A similar system is used for each register of the accordion.

The elements of one linkage system for a given register will now be described in detail. As shown in FIG. 1, the linkage system includes an L-shaped lever 7 pivotly connected to bracket 8 by a pin 40. Bracket 8 is affixed to frame 24 of the sound chamber by rivets, screws or other conventional means. One end of the L-shaped lever 7 is connected to a reed pallet or covers 16, 16' for opening and closing reeds 75 and 76. The other end of L-shaped member 7 includes a slot 44. Coil spring 66 (See FIG. 2) biases the pallets 16, 16' toward a closed position.

Connected to L-shaped lever 7 is a flat transmission lever 9 which has at one end a pin 48 which protrudes through slot 44. At the other end of flat transmission lever 9 is a pin 50, 50' which overlies classical key lever 15. Flat transmission lever 9 is pivotly connected to pivot support 10 through pivot pin 56, and pivot support 10 is in turn connected to frame 24 through a resilient flat leaf spring 11. Flat leaf spring 11 in its normal position biases support 10 toward frame 24. The invention further includes rod 13 which is eccentrically mounted to pivot about the exterior surface of pin 56. At the bottom end of rod 13 is a push bar 12 which is positioned under flat leaf spring 11. The other end of the rod 13 is connected to a control cord 64 containing a cable 14 operable by the player.

The linkage mechanism of the present invention permits the accordion operator to selectively use or not use the two additional sounds on the front of the accordion. When the classical key lever 15 is in its normal position, coil spring 66 biases the L-shaped member 7 and the pallet 16 into a closed position. To play the classical reeds 71, 72, 73 and 74 of the accordion as well as the new reeds 75 and 76, the mechanism is in position as shown in FIG. 1 and the operator merely has to push upon the classical key lever 15. Lever 15 operates to raise the pallets 81, 82, 83 and 84 on the four conventional reeds 71, 72, 73 and 74 and also will engage pin 50, 50' of flat transmission lever 9 counterclockwise about pin 56. The counterclockwise rotation of flat lever 9 imparts a clockwise rotation upon L-shaped lever 7 through the engagement of pin 48 with slot 44. Upon the clockwise rotation, reed pallet 16, 16' is lifted and reeds 76 or 75 are opened.

If the accordion operator desires to not use the new orders of sound, he merely needs to pull control cord 64 which rotates rod 13 in a clockwise direction thereby forcing push bar 12 under flat leaf spring 11 to a greater degree than now shown in FIG. 1. That action causes pivot support 10 to rise with respect to frame 24. The rotation of rod 13 lifts pivot support 10 to such an extent that classical key lever 15 will not touch pins 50, 50' and flat transmission lever 9, even when the key lever 15 is pressed to the open position. Therefore, if the cord 64 is pulled, the operation of classical key lever 15 will only open the classical reeds 71, 72, 73 and 74, not reeds 75 and 76.

In the preferred embodiment of the invention, the accordion sound chamber includes 15 registers and sufficient mechanical linkages for 13 registers. The device therefore effectively has 28 registers.

It will be apparent to those skilled in the art that various modifications and variations could be made in the embodiment of the present invention and the construction of the invention without departing from the scope or spirit of the invention.

Other embodiments of the invention will be apparent to those skilled in the art from consideration of the specification and practice of the invention disclosed herein. It is intended that the specification and example be considered as examplary only, with the true scope and spirit of the invention being indicated by the following claims.

What is claimed is:

1. A sound chamber for an accordion comprising:

a sound chamber frame, a plurality of classical reeds attached to said frame, a plurality of classical pallets positioned over said plurality of classical reeds to selectively open and close said plurality of classical reeds, said plurality of classical pallets being biased to a closed position, at least one new sound order reed attached to said frame, a new sound order pallet, positioned over said new sound order reed to selectively open and close said new sound order reed, said new sound order pallet being biased to a closed position, a classical key lever connected to said plurality of said classical pallets to selectively move said pallets to an open position when said classical key lever is placed in the play position, an L-shaped new order key lever pivotably connected to said frame to selectively move said new order pallet to an open position when said new order key lever is placed in the play position, said L-shaped lever being connected to said new order sound pallet at one end and having a slot at the other end, a pivot support connected to said frame and capable of being placed in an up or down position, a flat transmission lever pivotably connected to said pivot support and having a first pin protruding through said slot of said L-shaped lever and having a second pin overlapping said classical key lever to contact and move with said classical key lever when said pivot support is placed in the down position and said classical key lever is moved to the play position, and means for selectively placing said pivot support in an up or down position, whereby when said pivot support is in the down position, the movement of the classical key lever to the play position causes the pivoting of the flat transmission lever and the corresponding pivoting of said L-shaped lever to the play position.

2. The sound chamber of claim 1 wherein two classical pre-tuned reeds are positioned at the rear side of the frame and two classical pre-tuned reeds are positioned at the top side of said frame.

3. The sound chamber of claim 1 wherein said sound chamber has two new order sound reeds, said new order sound reeds being positioned at the forward portion of said frame.

* * * * *